US005616034A

United States Patent [19]

Masuda et al.

[11] Patent Number: 5,616,034

[45] Date of Patent: Apr. 1, 1997

[54] POWER SUPPLY APPARATUS FOR PACKAGE

[75] Inventors: Natsuo Masuda; Hiroshi Yamamoto; Haruhiko Horizoe; Shinji Hiramatsu; Hidehiko Hizuka; Manabu Matsumoto; Toshihiko Motoseko, all of Kawasaki, Japan

[73] Assignee: Fujitsu Limited, Kawasaki, Japan

[21] Appl. No.: 493,389

[22] Filed: Jun. 21, 1995

[30] Foreign Application Priority Data

Oct. 20, 1994 [JP] Japan ..... 6-254934

[51] Int. Cl.[6] ..... H01R 9/09

[52] U.S. Cl. ..... 439/78

[58] Field of Search ..... 439/60, 65, 78, 439/651, 655

[56] References Cited

U.S. PATENT DOCUMENTS

| | | | |
|---|---|---|---|
| 4,568,134 | 2/1986 | DiMondi | 439/78 X |
| 4,820,169 | 4/1989 | Weber et al. | 439/65 |
| 5,011,436 | 4/1991 | Waters | 439/78 X |
| 5,125,854 | 6/1992 | Bassler et al. | 439/607 |
| 5,454,726 | 10/1995 | Lee et al. | 439/65 |

*Primary Examiner*—Allan N. Shoap
*Assistant Examiner*—Christopher J. McDonald
*Attorney, Agent, or Firm*—Staas & Halsey

[57] ABSTRACT

A power supply apparatus for a package, in which power is supplied to a package connected to a shelf, aiming at supplying power to the package without using signal pins of a connecting part on a back wiring board and reducing voltage drop at a pattern on the back wiring board to a negligible degree. A fitting section of a package printed board and a fitting section are fitted to each end of a tab of the back wiring board, and a fitting section of a package printed board and a fitting section are fitted to each end of a tab of the back wiring board. Further, a connector on the package side of package printed board and a connector are fitted to each end of a signal terminal group of the back wiring board.

6 Claims, 11 Drawing Sheets

PRIOR ART

PRIOR ART

PRIOR ART

POWER SUPPLY APPARATUS FOR PACKAGE

BACKGROUND OF THE INVENTION

1. Field of the Invention

The present invention relates to an apparatus for supplying power to a package which consists of printed wiring boards and can be inserted to and withdrawn from a shelf and, more particularly, to an apparatus for supplying power to a plurality of packages which compose a high-density mounted communication system and require the supply of high capacity current.

2. Description of the Related Art

In recent years, the high-density of the communication system in a shelf configuration has been increasing the power consumption of each package which is a component of the system, and therefore, it is necessary to reliably supply high capacity current to the package.

In the conventional communication system having a plurality of packages which consume high power, connecting part which connects each package to the shelf and is disposed on a back wiring board, is composed of many pins and a large number of these pins are used for supplying power. For example, as shown in FIG. 9, which is a plan view of the connecting part, of 52 pins, a pin group 101 and a pin group 102, each group consisting of 20 pins, are used for supplying power for power supply plus side and minus side, respectively, and a pin group 103 consisting of other 12 points are used for the signal. Therefore, using many pins for supplying power enables high capacity current to be supplied to the package.

Such pin groups 101 and 102 for supplying power are disposed for each package, and in order to supply power from the shelf side to the pin group, a pattern on the power supply plus side for connecting the pin group on the power supply plus side is formed on the back wiring board on which the pin group is disposed, and a pattern on the power supply minus side for connecting the pin group on the power supply minus side is formed similarly, so that power is supplied from the shelf side to the pattern.

One method for supplying power from the shelf side to the pattern is to supply power by using a power supply connector for the pattern as shown in FIG. 10. The power supply connector 104 has the same shape as that of a signal connecting connector (not shown) and one connector 104 is provided for each shelf. Whereas the signal connecting connector is provided for each package to connect the signal line of the circuit in the package to the package circuit of another shelf via the signal pin 103 of the aforementioned connecting part. The power supply connector 104 connects the plus power supply from the shelf side to the pin group 101 for supplying power, and the minus power supply to the pin group 102 for supplying power. This connector 104 does not connect a signal line and is dedicated to power supply. Therefore, a package cannot be connected to the package side of the connecting part to which the power supply connector 104 is connected. In FIG. 9, reference numerals 105 and 106 denote patterns on the power supply plus and minus sides disposed on the back wiring board 107, respectively.

Another method for supplying power from the shelf side to the pattern is to supply power by fixing a power supply terminal to each pattern as shown in FIG. 11. In FIG. 11, the same reference numerals are applied to the elements common to FIG. 10, and the description is omitted. With the method to shown in FIG. 11, the power supply terminals 108 and 109 are fixed with screws to the patterns 105 and 106, respectively, so that power is supplied from the shelf side to the patterns 105 and 106.

In the conventional apparatus, however, of many pins composing the connecting part, a large number of pins must be used for power supply, so that there is a problem that the number of pins which can be used for the signal is decreased, despite the fact that it is naturally desirable to increase the number of pins using for the signal with the high-density of the system.

Further, the power is supplied to each package from the connector 104 or the terminal 108, 109 through a passage reaching the pin group for each package via the patterns 105 and 106 on the power supply plus and minus sides disposed on the back wiring board 107. However, since the increase in size of the patterns 105 and 106 is usually limited, the allowable amount of current of the patterns 105 and 106 is restricted, and a significant voltage drop occurs.

Further, as described above, a package cannot be connected to the package side of the connecting part to which the power supply connector 104 is connected, so that a wasteful space arises.

SUMMARY OF THE INVENTION

An object of the present invention is to provide a power supply apparatus for a package, in which power is supplied to the package without using signal pins of a connecting part on a back wiring board and voltage drop at a pattern on the back wiring board is reduced to a negligible degree.

To achieve the above object, there is provided an apparatus for supplying power to a package which consists of printed wiring boards and is connected to a shelf. The apparatus comprises: a first terminal provided on a back wiring board; a second terminal provided on the back wiring board; a third terminal consisting of a plurality of pins provided on the back wiring board; a fourth terminal provided at a position of a package, where the fourth terminal can be fitted to the first terminal, and connected to a first power supply side of a circuit in the package; a fifth terminal provided at a position of the package, where the fifth terminal can be fitted to the second terminal, and connected to a second power supply side of the circuit in the package; a sixth terminal provided at a position of the package, where the sixth terminal can be fitted to the third terminal, and consisting of a plurality of pins connected to each signal line of the circuit in the package; a seventh terminal fitted to the first terminal for supplying a first power; an eighth terminal fitted to the second terminal for supplying a second power; and a ninth terminal fitted to the third terminal and consisting of a plurality of pins connected to an external signal line.

The above and other objects, features and advantages of the present invention will become apparent from the following description when taken in conjunction with the accompanying drawings which illustrate preferred embodiment of the present invention by way of example.

DESCRIPTION OF THE PREFERRED EMBODIMENTS

First, the principle of the present invention will be described with reference to the embodiment shown in FIG. 1.

Figure 1:
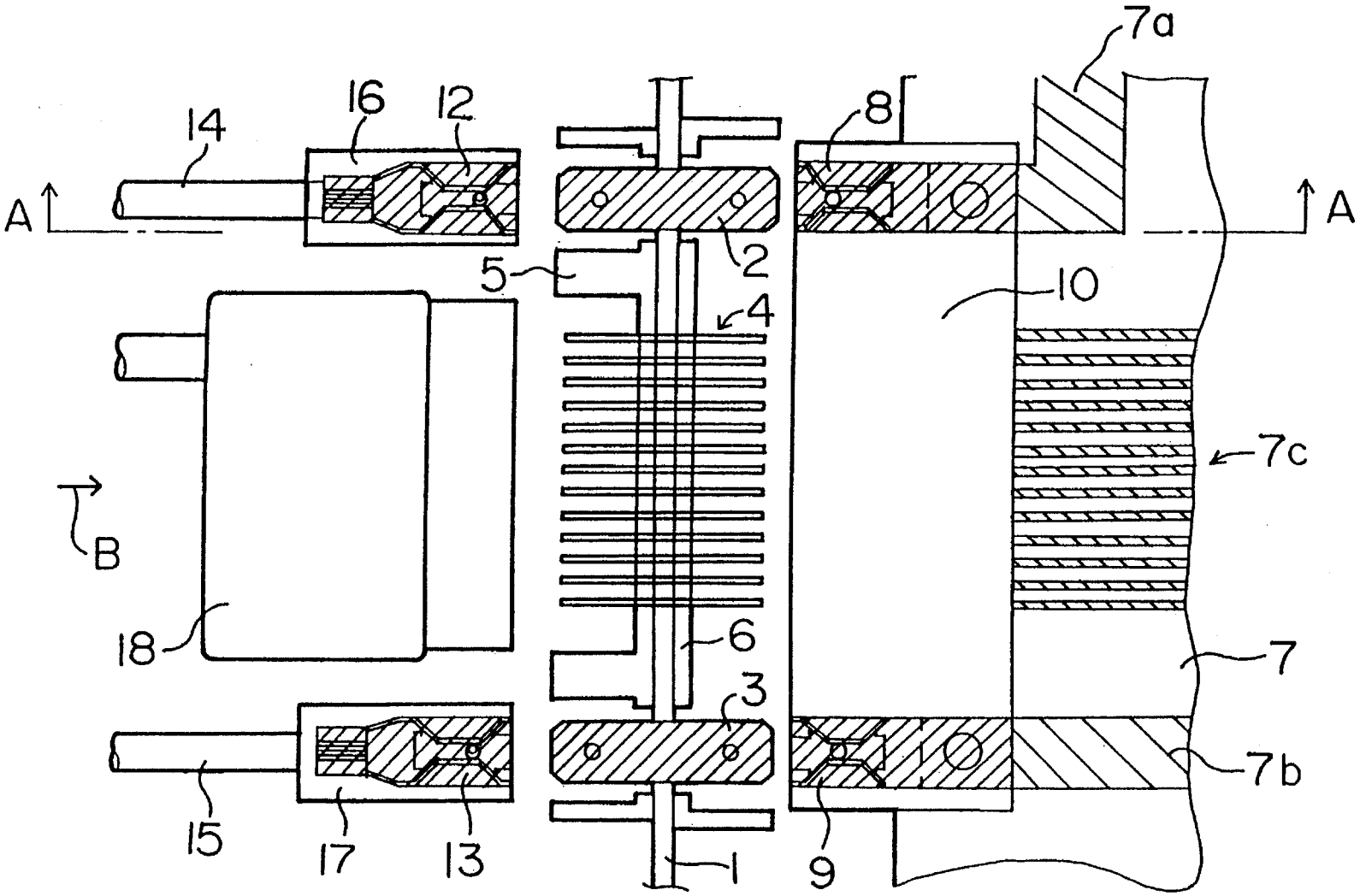
FIG. 1 is a plan view showing a configuration of a first embodiment.

As shown in FIG. 1, the present invention comprises a first terminal 2 disposed on a back wiring board 1, a second terminal 3 disposed on the back wiring board 1, a third terminal 4 consisting of a plurality of pins disposed on the back wiring board 1, a fourth terminal 8 which is provided at a position of a package 7 where the fourth terminal 8 is fitted to the first terminal 2 and connected to the first power supply side of the circuit in the package 7, a fifth terminal 9 which is provided at a position of the package 7 where the fifth terminal 9 is fitted to the second terminal 3 and connected to the second power supply side of the circuit in the package 7, a sixth terminal 10 consisting of a plurality of pins which is provided at a position of the package 7 where the sixth terminal 10 is fitted to the third terminal 4 and connected to each signal line of the circuit in the package 7, a seventh terminal 12 which is fitted to the first terminal 2 and supplies a first power, an eighth terminal 13 which is fitted to the second terminal 3 and supplies a second power, and a ninth terminal 18 consisting of a plurality of pins which is fitted to the third terminal 4 and is connected to an external signal line.

In the above configuration, the fourth terminal 8 and the seventh terminal 12 in the package 7 are fitted to each end of the first terminal 2 in the back wiring board 1, and the fifth terminal 9 and the eighth terminal 13 in the package 7 are fitted to each end of the second terminal 3 in the back wiring board 1. Further, the sixth terminal 10 and the ninth terminal 18 in the package 7 are fitted to each end of the third terminal 4 in the back wiring board 1.

Accordingly, the external first power supply side is connected to the first power supply side of the circuit in the package 7, and the external second power supply side is connected to the second power supply side of the circuit in the package 7 without using the third terminal 4 in the back wiring board 1 at all.

Next, the embodiment of the present invention will be described in detail.

Figure 2:
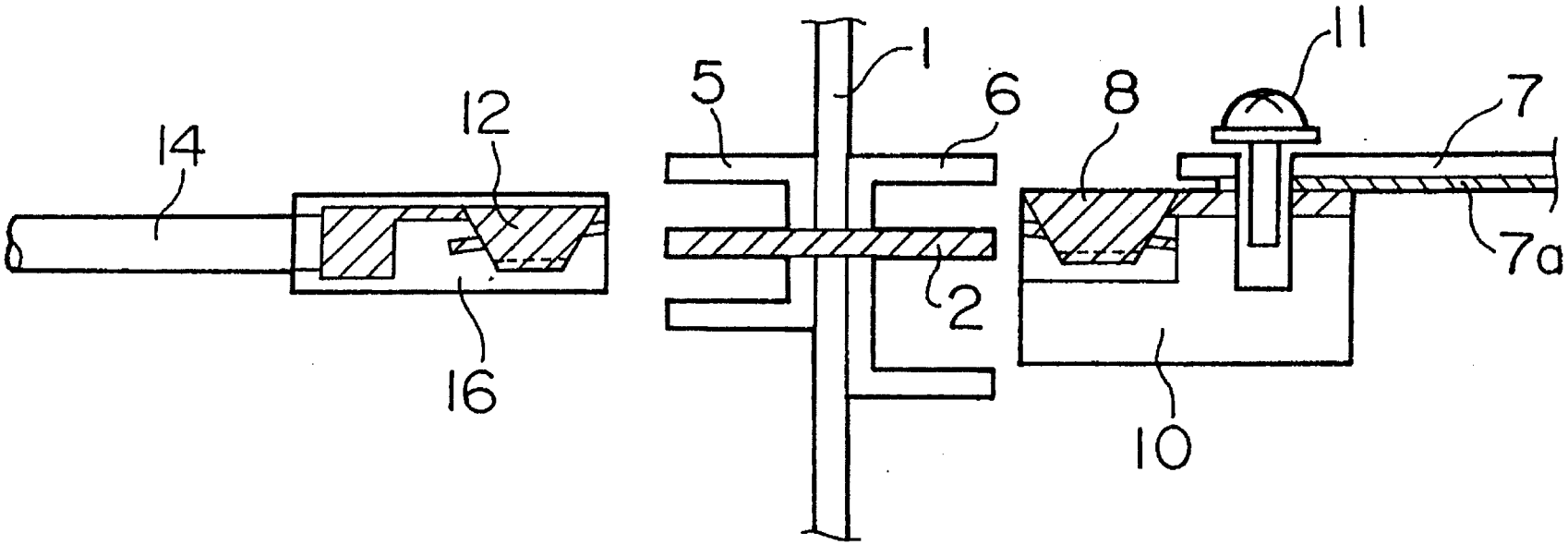
FIG. 2 is a side view taken along the plane A—A of FIG. 1.

FIG. 1 is a plan view showing a configuration of a first embodiment, and FIG. 2 is a side view taken along the plane A—A of FIG. 1. The hatched portions in both figures represent conductors made of metal, which is true in the other drawings described hereinafter.

Figure 3:
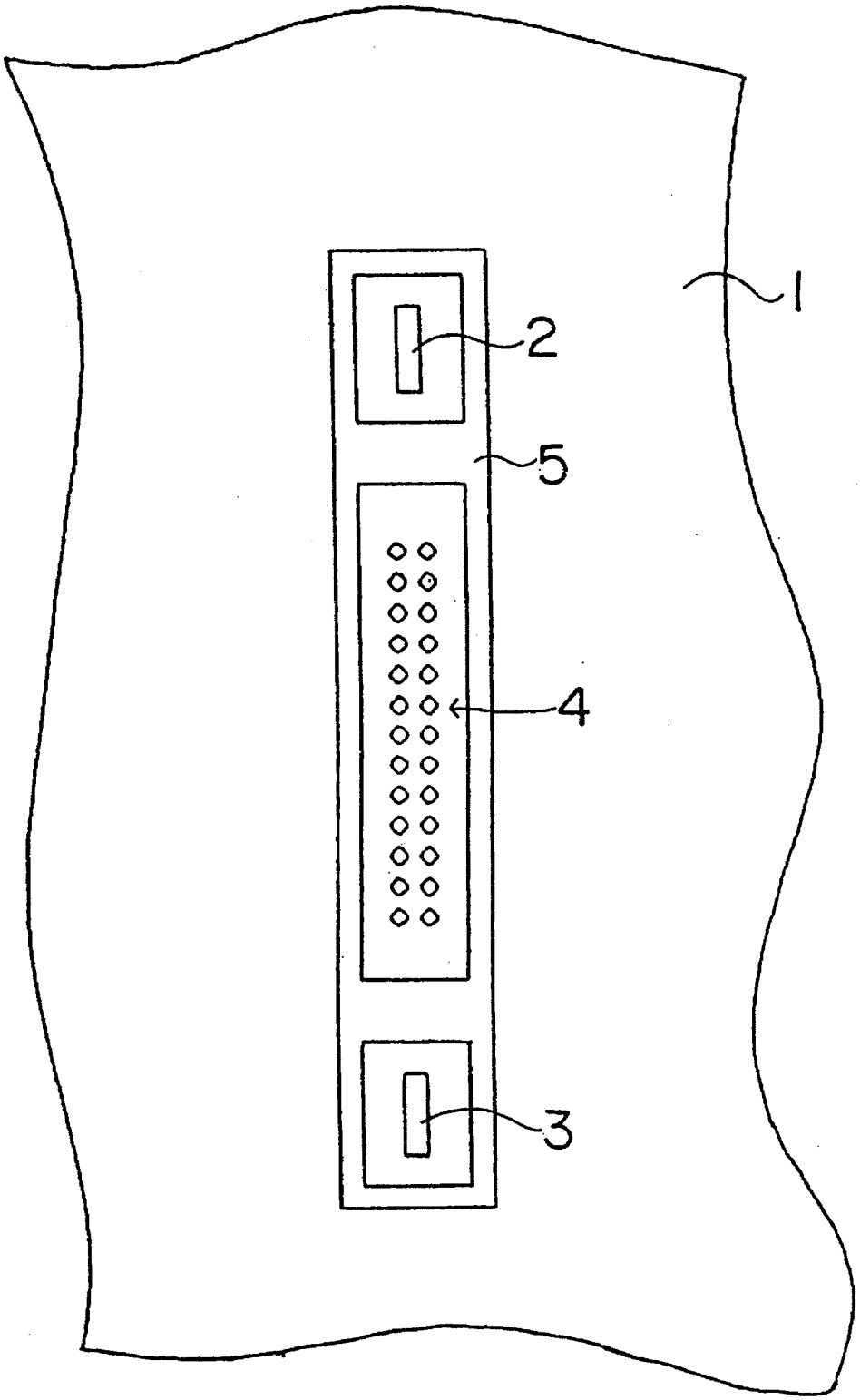
FIG. 3 is an outside view of a housing viewed in B direction of FIG. 1.

Referring to FIGS. 1 and 2, the back wiring board 1, which is provided in a shelf (not shown), has power supply tabs 2 and 3 and a group of a number of signal terminals 4 embedded therein at right angles to the face of the back wiring board 1 in such a manner as to be exposed from the back wiring board 1 at both ends. The tabs 2 and 3 are made of a metallic material having a cross-sectional area enough to withstand the passage of high capacity current. On one side of the back wiring board 1 is provided a housing 5. This housing 5 is constructed so that the power supply tabs 2 and 3 are electrically isolated from the signal terminal group 4. FIG. 3 is an outside view of a housing viewed in B direction of FIG. 1. On the other side of the back wiring board 1 is provided a housing 6.

A package printed board 7 has a power supply plus side pattern 7*a*, a power supply minus side pattern 7*b*, a signal connection pattern 7*c* consisting of a group of a plurality of signal connection lines. The power supply plus side pattern 7*a* and the power supply minus side pattern 7*b* are connected to the power source plus side and the power source minus side (ground side) of an electronic circuit provided on the package printed board 7, respectively, and the signal connection pattern 7*c* is connected to each signal section of the electronic circuit. At the end of the package printed board 7, fitting sections 8 and 9 and a package side connector 10 are provided. The fitting section 8 is arranged at a position such as to be fitted to the power supply tab 2 and connected to the power supply plus side pattern 7*a*. The fitting section 9 is arranged at a position such as to be fitted to the power supply tab 3 and connected to the power supply minus side pattern 7*b*. The package side connector 10 has a plurality of fitting pieces (not shown), which are connected to the signal connection pattern 7*c* and arranged at a position such as to be fitted to the signal terminal group 4. Also, the package side connector 10 contains the fitting sections 8 and 9, and is capable of being inserted into the housing 6. The fitting sections 8 and 9 are made of an elastic material, and are constructed so as to hold the plate-shaped tabs 2 and 3 in-between, respectively. The portions of the fitting sections 8 and 9 which are connected to the power supply plus side pattern 7*a* and the power supply minus side pattern 7*b* are of a planar shape so as to be in surface contact with the patterns. The fitting section 8 is fixed to the package printed board 7 with a screw 11. Similarly, the fitting section 9 is fixed to the package printed board 7 with a screw.

The fitting sections 12 and 13, which are fitted to the power supply tabs 2 and 3, respectively, are made of an elastic material, and are constructed so as to hold the plate-shaped tabs 2 and 3 in-between, respectively. Wires 14 and 15 are connected to the fitting sections 12 and 13 so that plus power and minus power are supplied from the outside to the fitting sections 12 and 13 through the wires 14 and 15, respectively. The fitting sections 12 and 13 are covered by housings 16 and 17, respectively, and the housings 16 and 17 are capable of being inserted into the housing 5.

A connector 18 is equipped with a plurality of fitting sections, each of which is fitted to the signal terminal group 4, and these plurality of the fitting sections are connected to an external circuit, for example, the circuit of the package in another shelf. In addition, the connector 18 is in such a configuration as can be fitted to the housing 5.

Since the apparatus is configured as described above, when the package side connector 10 is fitted to the housing 6 and the housings 16 and 17 and the connector 18 are fitted to the housing 5, the plural fitting pieces in the connector 18 are fitted to the signal terminal group 4, the terminal group 4 is fitted to the plural pieces in the package side connector 10, the fitting section 12 is fitted to the tab 2, the tab 2 is fitted to the fitting section 8, the fitting section 13 is fitted to the tab 3, and the tab 3 is fitted to the fitting section 9.

Therefore, an external signal circuit is connected to the signal circuit in the package printed board 7. Also, an external plus power supply is electrically connected to the power supply plus side pattern 7*a* through the wire 14, the fitting section 12, the tab 2, and the fitting section 8 in sequence. An external minus power supply is electrically connected to the power supply minus side pattern 7*b* through the wire 15, the fitting section 13, the tab 3, and the fitting section 9 in sequence.

Figure 4:
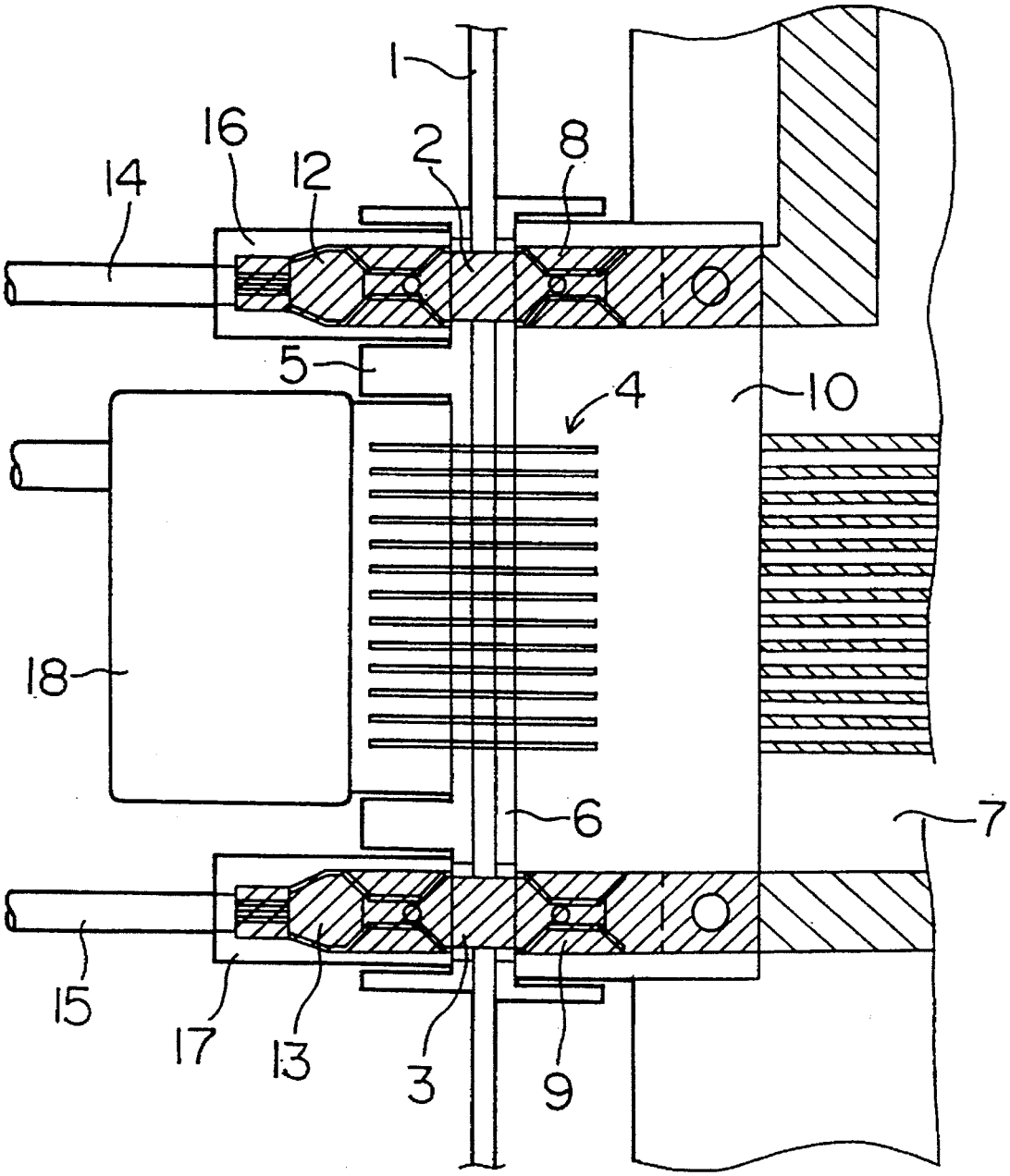
FIG. 4 is a view showing a state after fitting, corresponding to FIG. 1.
Figure 5:
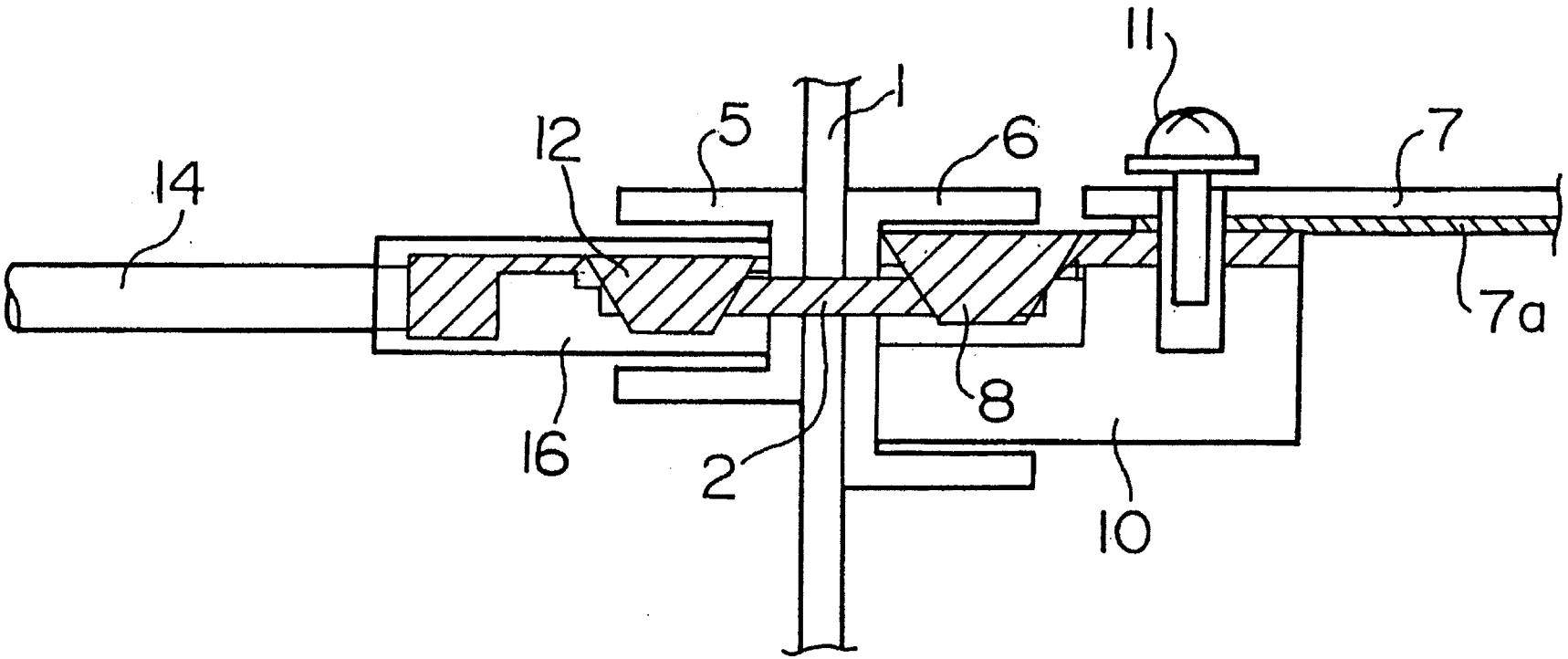
FIG. 5 is a view showing a state after fitting, corresponding to FIG. 2.

FIGS. 4 and 5 shows a state in which such fitting has been accomplished. FIGS. 4 and 5 correspond to FIGS. 1 and 2, respectively.

Since the special-purpose power supply tabs 2 and 3 are provided independently of the signal pins of the connecting part on the back wiring board, there is no need for using the signal pins of the connecting part for supplying power. Therefore, even if the desired number of signal pins of the connecting part increases as the density increases, or even if the amount of power supplied to the package is increased, there occurs no problem. For example, when the maximum current capacity of the power supply tab is 30 A, the power supply tab is equivalent to 60 signal pins because the allowable current value of the signal pin is 0.5 A.

Also, since the housing 5 isolates the power supply tabs 2 and 3 from the signal terminal group 4, the interference of power noise with the signal pins can be reduced.

Next, a second embodiment will be described.

Figure 6:
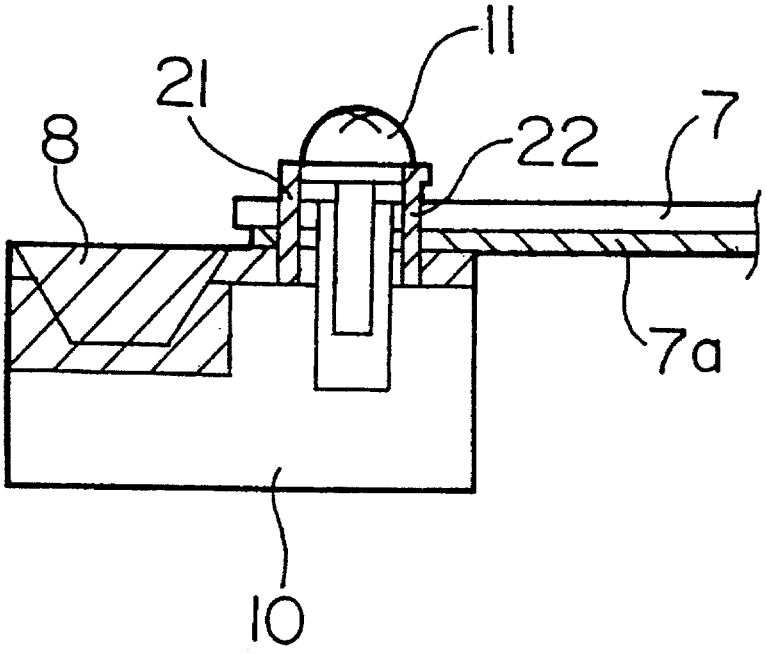
FIG. 6 is a view showing a connecting part between a fitting section and a pattern of a second embodiment.

FIG. 6 is a view showing a connecting part between a fitting section and a pattern of a second embodiment. The second embodiment provides a reliable electrical connection between the fitting section and the pattern in the package. In the second embodiment, which has basically the same configuration as the first embodiment, the same reference numerals are applied to the same elements, and the description is omitted.

In the second embodiment, solder dipping leads 21 and 22 are provided at the fitting section 8. These leads 21 and 22 are soldered to the power supply plus side pattern 7*a* in solder dipping, by which the fitting section 8 is reliably connected to the power supply plus side pattern 7*a* via the leads 21 and 22. Similarly, soldering is performed between the fitting section 9 and the power supply minus side pattern 7*b* via the leads.

Next, a third embodiment will be described.

Figure 7:
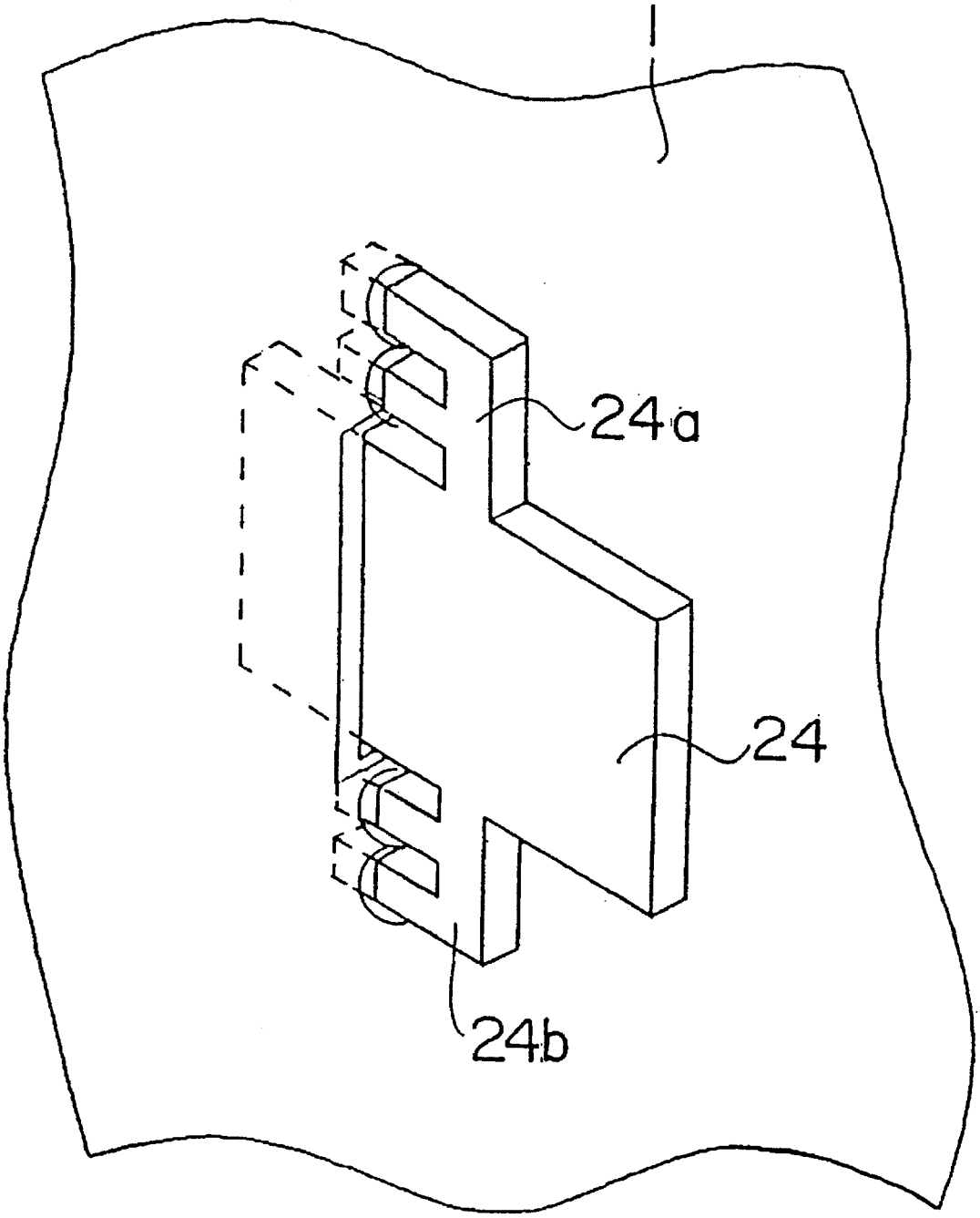
FIG. 7 is a view showing a shape of a tab of a third embodiment.

FIG. 7 shows a tab of the third embodiment. In the third embodiment, the special-purpose power supply tab has a shape different from that of the first embodiment. Specifically, at the side of the plate-shaped tab 24, leg portions 24*a* and 24*b* are provided so that the leg portions 24*a* and 24*b* are fixed to the back wiring board 1. This can increase the strength of fixing of the tab 24 to the back wiring board 1.

Next, a fourth embodiment will be described.

Figure 8:
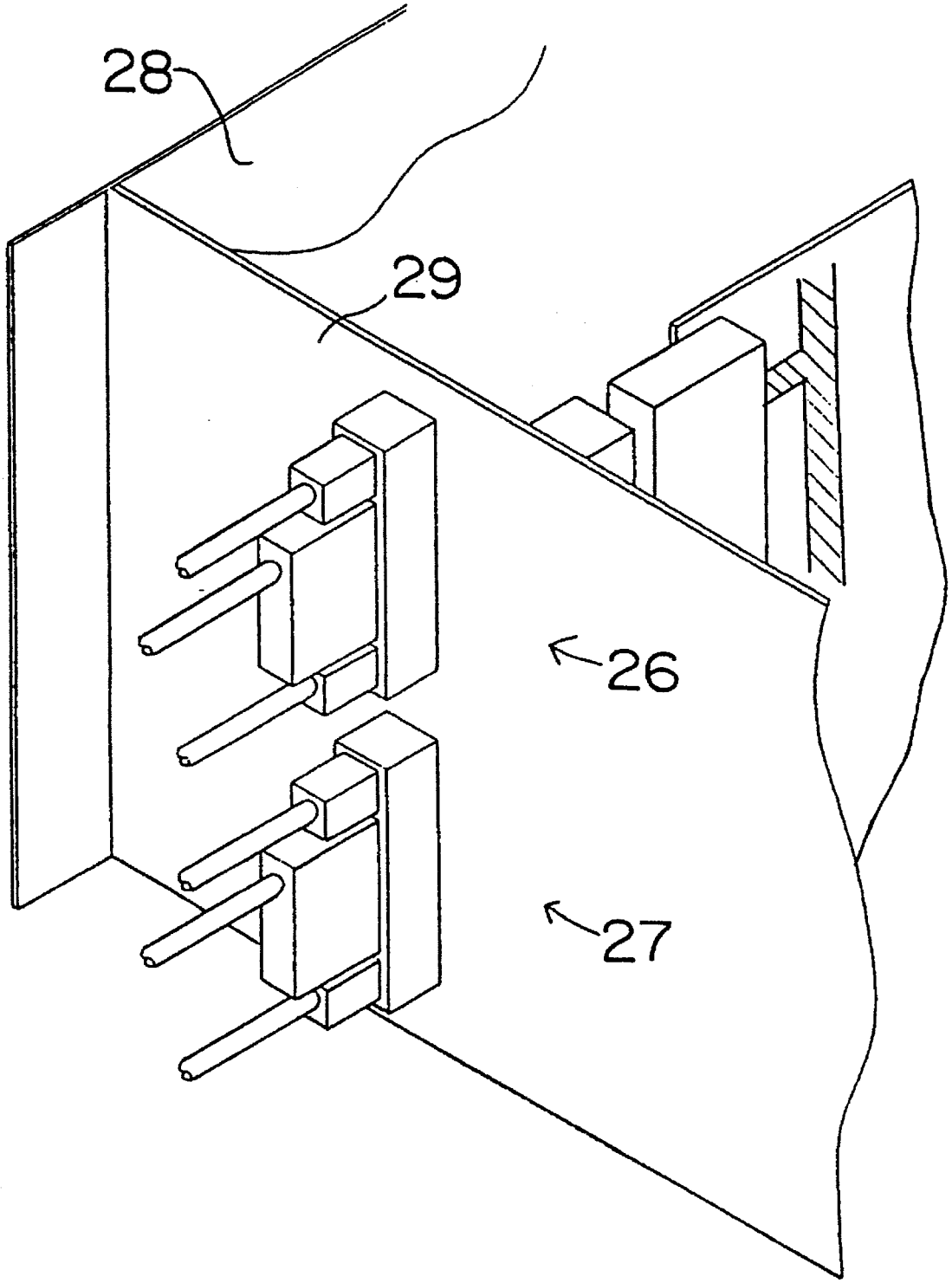
FIG. 8 is a configuration view of a fourth embodiment.
Figure 9:
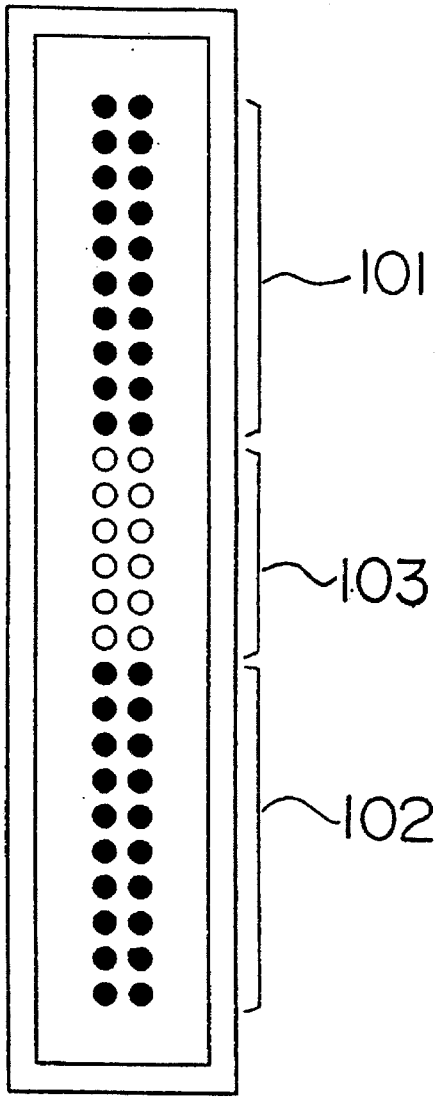
FIG. 9 is a plan view of a conventional connecting part.
Figure 10:
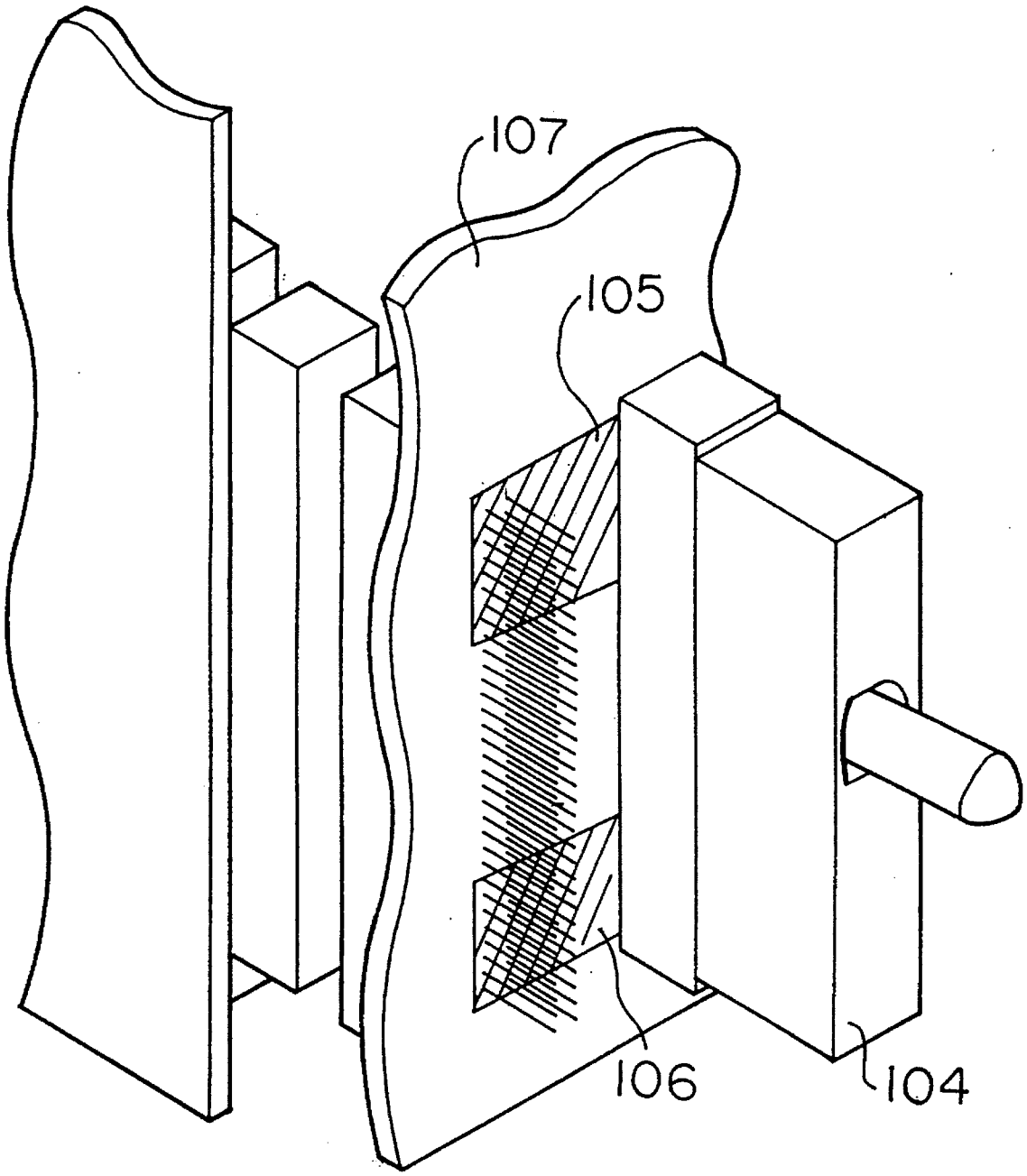
FIG. 10 is a perspective view of a conventional power supply connector.
Figure 11:
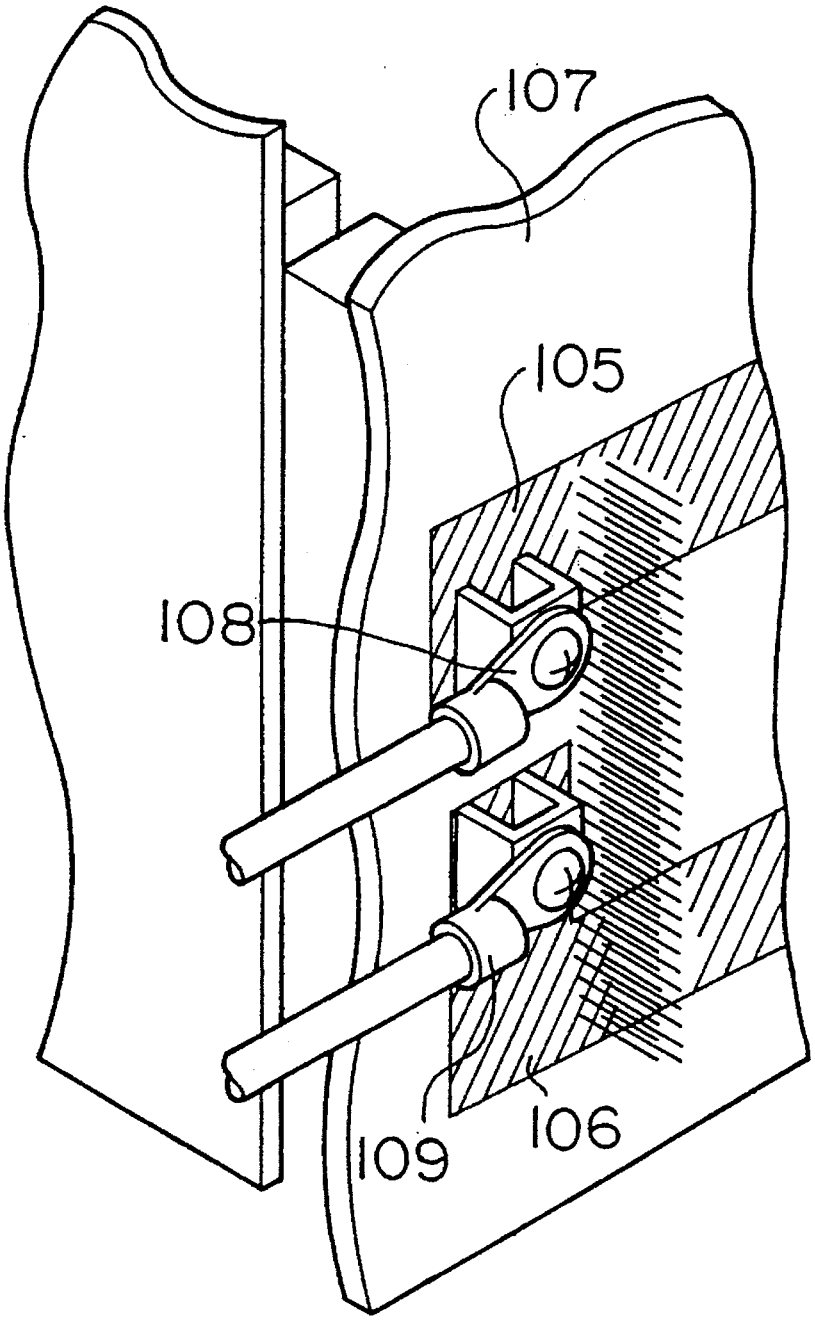
FIG. 11 is a conventional power supply terminal.

FIG. 8 is a perspective view showing the configuration of the fourth embodiment. In the fourth embodiment, a plurality of power supply apparatuses 26 and 27 having the same configuration as that of the first embodiment are provided in the shelf 28. The plural power supply apparatuses 26 and 27 are arranged at equal intervals on the back wiring board 29. Thus, power is supplied to the peripheral package having no power supply apparatus from the above-described power supply apparatuses through a power supply pattern (not shown) provided on the back wiring board 29. Thereupon, the extension of the power supply pattern is decreased as compared with the case where one power supply apparatus is provided in the shelf, so that the voltage drop at the extension decreases. Also, by providing plural power supply apparatuses, the amount of current which must pass through the power supply pattern decreases.

In the fourth embodiment, the number of the power supply apparatuses does not necessarily coincide with the number of the packages, but instead, the power supply apparatus may be installed for each package. In this case, the power supply pattern need not be provided on the back wiring board.

As described above, in the present invention, the special-purpose power supply tabs are provided independently of the signal pins of the connecting part on the back wiring board. Thereupon, the signal pins of the connecting part need not be used for power supply. Therefore, even if the desired number of signal pins of the connecting part increases as the density increases, or even if the amount of power supplied to the package is increased, there occurs no problem.

Further, a plurality of power supply apparatuses are provided in the shelf. Thereupon, the extension of the power supply pattern is decreased as compared with the case where one power supply apparatus is provided in the shelf, so that the voltage drop at the extension decreases. Also, by providing plural power supply apparatuses, the amount of current which must pass through the power supply pattern decreases, resulting in the decrease in pattern load. If the power supply apparatus is provided for each package, the need for power supply pattern itself is eliminated, so that the problems of voltage drop and allowable amount of current at the pattern are solved.

Still further, since the power supply terminals are electrically isolated from the signal terminal group, the interference of power noise with the signal terminal group can be reduced.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An apparatus for supplying power to a package, which consists of printed wiring boards and is connected to a shelf, comprising:

a first terminal provided on a back wiring board;

a second terminal provided on said back wiring board;

a third terminal consisting of a plurality of pins provided on said back wiring board;

a fourth terminal provided at a position of a package, where said fourth terminal can be fitted to said first terminal, and connected to a first power supply side of a circuit in said package;

a fifth terminal provided at a position of said package, where said fifth terminal can be fitted to said second terminal, and connected to a second power supply side of the circuit in said package;

a sixth terminal provided at a position of said package, where said sixth terminal can be fitted to said third terminal, and consisting of a plurality of pins connected to each signal line of the circuit in said package;

a seventh terminal fitted to said first terminal for supplying a first power;

an eighth terminal fitted to said second terminal for supplying a second power; and a ninth terminal fitted to said third terminal and consisting of a plurality of pins connected to an external signal line.

2. An apparatus according to claim 1, wherein said fourth and fifth terminals include respective contact means which are in surface contact with a first power supply side pattern and a second power supply side pattern of a printed wiring board composing said package, respectively.

3. An apparatus according to claim 1, wherein said fourth and fifth terminals include respective bonding means for solder dip bonding said terminals to a first power supply side pattern and a second power supply side pattern of a printed wiring board composing said package, respectively.

4. An apparatus according to claim 1, further comprising a housing for electrically isolating said third terminal from said first and second terminals.

5. An apparatus according to claim 1, wherein said first and second terminals are each composed of one pin having a cross-sectional area larger than those of plural pins composing said third terminal.

6. An apparatus according to claim 1, wherein a plurality of packages can be mounted for said shelf, and a plurality of sets of power supply means, in which said first to ninth terminals are one set, are provided for said shelf.

* * * * *